United States Patent [19]

Nakayama et al.

[11] Patent Number: 4,907,809

[45] Date of Patent: Mar. 13, 1990

[54] GAME KIT UTILIZING BOARD AND PIECES

[75] Inventors: Akihiro Nakayama; Tomoko Tachiki, both of Tokyo, Japan

[73] Assignee: Takio Kurokawa, Tokyo, Japan

[21] Appl. No.: 203,736

[22] Filed: Jun. 7, 1988

[51] Int. Cl.[4] ..... A63F 3/02; A63F 3/00

[52] U.S. Cl. ..... 273/242; 273/291

[58] Field of Search ..... 273/242, 236, 291, 260, 273/261, 258, 264, 271, 253; D21/24, 33, 34, 36, 53

[56] References Cited

U.S. PATENT DOCUMENTS

| | | | |
|---|---|---|---|
| D.270,922 | 10/1983 | Astergard | D21/34 |
| 1,204,006 | 11/1916 | Goldmerstein | 273/291 |
| 3,918,715 | 11/1975 | Puglisi | 273/291 |
| 4,739,992 | 4/1988 | May | 273/291 |

FOREIGN PATENT DOCUMENTS

| | | | |
|---|---|---|---|
| 698755 | 11/1931 | France | 273/261 |

*Primary Examiner*—Edward M. Coven
*Assistant Examiner*—Benjamin Layno
*Attorney, Agent, or Firm*—Christie, Parker & Hale

[57] ABSTRACT

The present invention provides a game kit comprising a board and a plurality of pieces. The playing field of the board comprises a plurality of intersecting points created by three sets of parallel line segments meeting at an angle of 60°. The points are especially marked to designate the locations on which the pieces are to be placed, with the object of forming equilateral triangles. Interspersed between each of the three sets of parallel line segments is an auxiliary set of parallel line segments. The auxiliary line segments create a second set of intersecting points on the board which may be used as an aid in identifying the location of potential triangles. The game pieces may be played selectively with their face or back directed upwards to designate the players and are provided with markings to identify said face and back. The equilateral triangles are formed by players strategically placing their pieces, in turn one piece at a time, on the unoccupied specially marked intersecting points. A player may use his (her) turn by alternatively moving one of his (her) pieces, already on the board, to a selected adjacent unoccupied point. When an opponent's piece(s) are confined within a player's formed equilateral triangle, these confined pieces are captured and taken off the board. The player who takes all of the opponent's pieces off the board wins.

5 Claims, 6 Drawing Sheets

GAME KIT UTILIZING BOARD AND PIECES

FIELD

The present invention relates to a game kit utilizing a game board and a plurality of pieces.

PRIOR ART

Various types of game kits utilizing game boards and pieces have already been proposed, such as the games utilizing geometric crosses or boxes (squares) formed by orthogonal lines. For example, GO, SHOGI (Japanese chess) and OTHELLO (registered trademark). The character common to these games lies in that the crosses or boxes on the board are defined by the apices or the four sides of each orthogonal tetragon, respectively.

SUMMARY OF THE INVENTION

An embodiment of the present invention provides a novel game employing a geometric strategy substantially different from the well known games based on the orthogonal coordinate system.

Briefly, an embodiment of the present invention resides first in a game kit comprising a game board formed thereon with crosses corresponding to respective intersecting points of line segments and a plurality of pieces to be set up on said crosses, characterized in that said crosses correspond to intersecting points of at least two groups of line segments each group of line segments extending in parallel to one another and intersecting at an angle of 60° the other group of line segments and all the line segments of said both groups extending at uniform intervals, respectively; and that each of said pieces is adapted to be used on the game board selectively with its face or back directed upwards and provided with markings to identify said face and back.

An alternate embodiment of the invention, is provided with an additional feature that the crosses are provided with markings of three different types in such a manner that these markings of three different types are sequentially repeated along all the line segments and thereby said crosses are identified.

With the game kit utilizing the board and pieces of the above-construction, a basic game pattern is offered, in which an equilateral triangle is strategically formed by setting up three pieces on the crosses corresponding to the apices defining said equaliteral triangle to take the pieces of the opponent placed on the crosses confined by three sides of this equiliateral triangle. Such equilaterial triangle defined by three crosses may be variable in its size, position and orientation so that the game can be played with fully exercised penetrative, imaginative and creative power.

DETAILED DESCRIPTION

Figure 1:
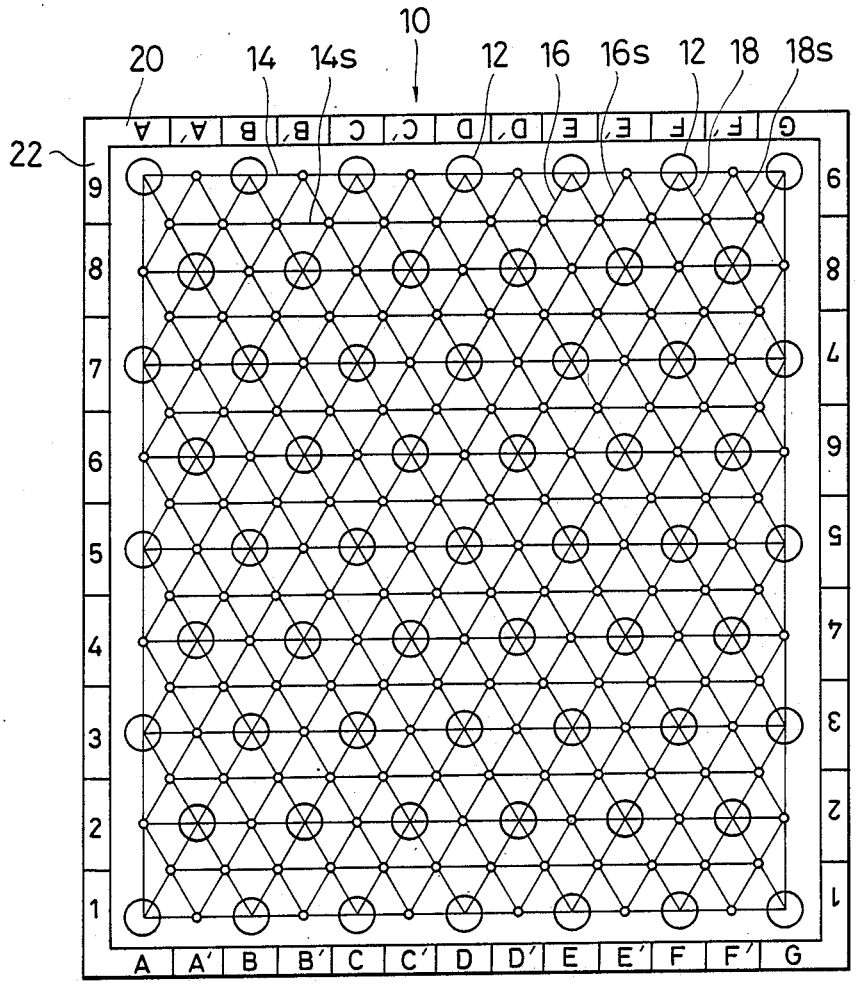
FIG. 1 is a top view showing an embodiment of the game kit utilizing the board and pieces according to the present invention.
Figure 2:
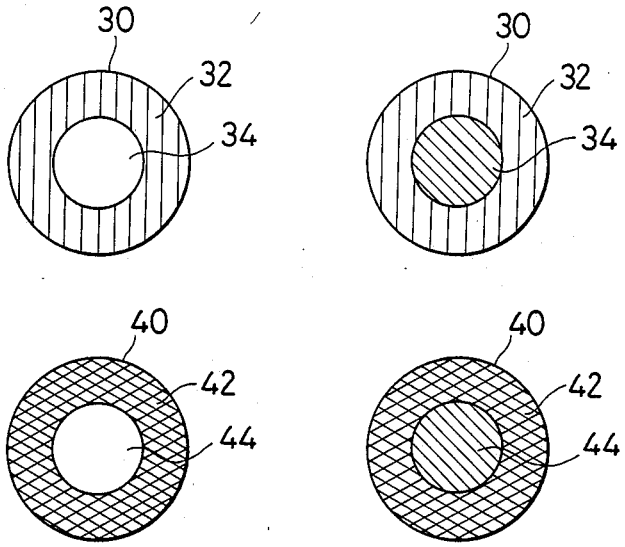
FIG. 2 includes a face view and a back view of the pieces according to the same embodiment.

FIG. 1 is a plan view showing a game board in a first embodiment of the game kit constructed according to the present invention and FIG. 2 is a plan view showing faces and backs of respective pieces in this embodiment.

Referring to FIG. 1, reference numeral 10 designates the game board made of cloth, paper, metal, wood, plastics etc., whereupon crosses 12, 12, ... are encircled by circles, respectively. These crosses 12 substantially correspond to intersecting points of horizontal line segments 14 extending in parallel to one another at regular intervals, leftwardly descending oblique line segments 16 extending in parallel to one another at the regular intervals same as those for said holizontal line segments 14 and intersecting the latter at an angle of 60° and rightwardly descending line segments 18 extending in parallel to one another at the regular intervals same as those for said horizontal line segments 14 and through the respective intersecting points of said horizontal line segments 14 and said leftwardly descending line segments 16 at an angle of 60°. Thus, the crosses correspond to the apices of the respective equilateral triangles formed by said line segments 14, 16 and 18.

According to this embodiment, there are additionally provided on the game board auxiliary line segments 14*s*, 16*s* and 18s extending midway between the respective pairs of adjacend line segments 14, 14, 16, 16 and 18, 18. There is also provided along the outer periphery a series of alphabetical characters and a series of numbers to represent coordinates of the respective crosses 12. For example, the left lower corner cross 12 is represented by (A, 1) and the immediately right upper cross 12 is represented by (A′, 2).

Referring to FIG. 2, reference numeral 30 and 40 designate discoidal pieces, respectively, both of which have flat faces and flat backs. The piece 30 has its main body 32 colored in red, defining a coaxial inner circule 34 having white face and green back. The piece 40 has its main body 42 colored in black, carrying a coaxially inner circle 44 having a white face and a green back. It should be understood here that the color differences are represented by oblique lines, crossing lines etc., because the drawing can not be colored.

Now it will be described, by way of example, how to play a game using the game board 10 and the pieces 30, 40 of the abovementioned constructions.

SYNOPSIS OF GAME

The game is played by a pair of players facing each other over the board 10 as in GO and SHOGI (Japanese chess), in which each of the players strategically sets up the pieces 30 or 40 on the respective crosses of the game board 10 so as to form an eqilateral triangle defined by these pieces 30, 40 and takes the piece(3) 30, 40 of the opponent player when this (these) pieces(s) 30, 40 is (are) confined within this eqilateral triangle.

KIT USED FOR GAME (1) the game board 10; and (2) the pieces 30 and the pieces 40, respectively 20 in number.

WIN AND LOSS (1) The game is concluded when one of the players has taken entirely the pieces 30, 40 of the opponent player off from the game board 20 and the player who has thus taken all the pieces 30, 40 becomes the winner.

(2) The game is concluded also when the issue has become apparent in the course of the game although several pieces 30, 40 still remain to be set up on the game board 10 that the game will be lost and one of the players gives up. In such a case, the player who has given up becomes the loser.

PROGRESS OF THE GAME (1) A pair of players face each other over the game board 10.

(2) Each player holds ten of the pieces 30 and ten of the pieces 40.

(3) The first mover and the second mover are decided by playing janken (a game of "paper-scissors-stone"), drawing lots, or the like. The first mover and the second mover can, in this order, alternately place or move the pieces 30, 40 on selected crosses or from crosses to crosses, respectively, one at a time, with the green inner circles of these pieces 30, 40 being directed upwards for the first mover and with the white inner circles of these pieces 30, 40 being directed upwards for the second mover.

HOW TO PLAY (1) Each player, in his(her) turn, can place one of his(her) pieces 30, 40 on selected on of unoccupied crosses 12 or move one of his(her) pieces 30, 40 which have already been set up on the crosses 12 to selected one of the adjacent unoccupied corsses 12.

Figure 3:
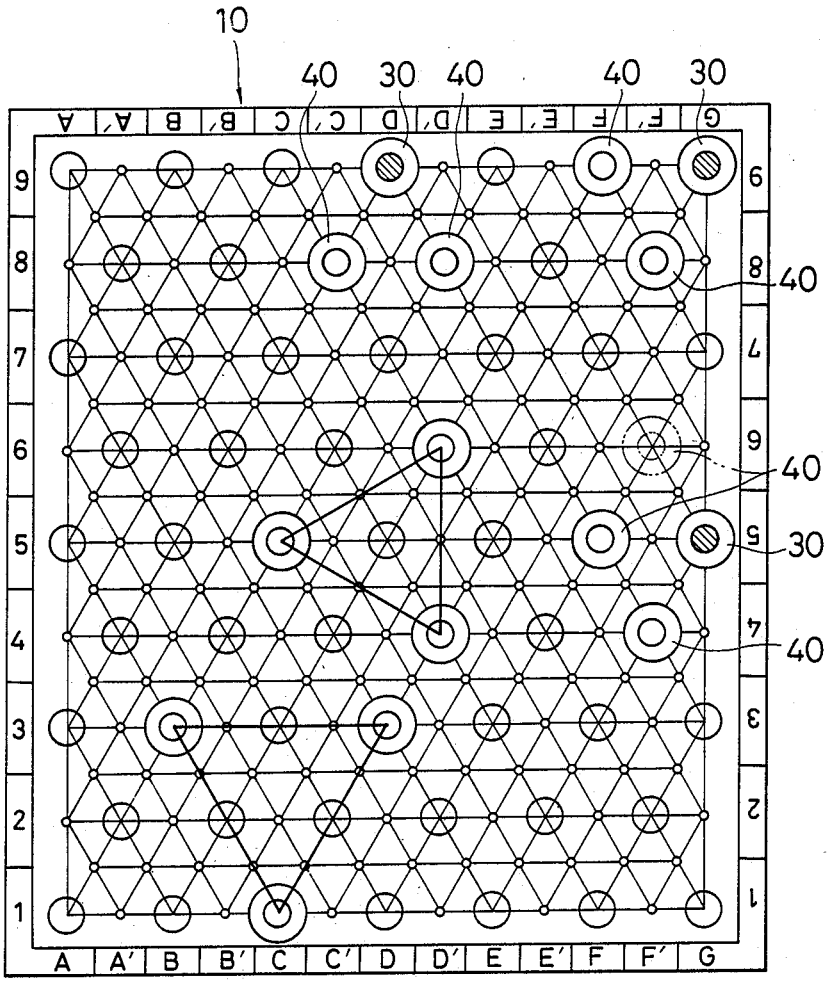
FIGS. 3 and 4 are diagrams illustrating how to play a game using the same embodiment.

For example, the piece 30 represented by the coordinate (D', 6) in FIG. 3 can be moved to any one of six crosses 12 around this cooridnate. It should be noted here that, when these six crosses 12 have already been occupied by the pieces 30, 40 it is impermissible for each player to place his(her) pieces 30, 40 on these occupying pieces 30, 40 themselves, or to move to the corresponding crosses 12 after removal of these previously occupying pices 30, 40 from these crosses 12, or to jump over these preoccupying pieces 30, 40 to the adjacent unoccupied crosses 12, no matter whether these preoccupying pieces 30, 40 are his(her) pieces or the opponent player's pieces.

(2) Once an equilateral triangle has been formed by his(her) pieces 30 or 40 of same type and thereby the opponent player's pieces 30 or 40 has been effectively confined within this equilateral triangle, the player can take the opponent player's pieces 30 or 40 thus confined. The equilateral triangle should be formed in accordance with the following rules:

(i) The equilateral triangle should be formed with three pieces 30 or 40 of same type;

(ii) His (her) own piece(s) may be contained within this equilateral triangele but, when both the red piece(s) 30 and black piece(s) 40 of the opponent player are contained within the equilateral triangle, these pieces of the opponent player can not be taken; and (iii) Two pieces on the outermost crosses 12 can be taken. For example, referring to FIG. 3, the piece 30 presenting the green inner circle on its face, which is represented by (G, 9) can be taken by placing the pieces 40 presenting the white inner circles on the crosses represented by (F', 8) and (F, 9), respectively, the piece 30 presenting the green inner circle on its face, whichis represented by (D, 9) can be taken by placing the pieces 40 presenting the white inner circles on the crosses corresponding to (C', 8) and (D', 8), respectively, and the piece 30 presenting the green inner circle on its top, which is represented by (G, 5) can be taken by placing the pieces 40 presenting the white inner circles on the crosses corresponding to (F, 5) and (F', 4) or (F', 6), respectively.

(3) The pieces 30, 40 thus taken can be used as so-called captured pieces.

TYPES OF EQUILATERAL TRIANGLE

The equilaterial triangle is generally grouped into three types as following:

(1) Erected or inverted equilateral triangle

This is the equilateral triangle of which the three sides connecting three crosses 12 comprise the horizontal line segment 14, the leftward descending oblique line segment 16 and the rightward descending olbique line segment 18. In other words, this equilateral triangle has a horizontal side as shown in the left lower area of the game board 10 in FIG. 3.

(2) Laterally pointing equilateral triangle

This is the equilateral triangle for which the horizontal line segment 14, the leftward descending oblique line segment 16 and the righward descending oblique line segment 18 passing through three crosses 12, respectively, intersect one another at a centre of this triangle. In other words, this equilateral triangle has a vertical side as shown in the central area of the game board 10 in FIG. 3.

(3) Hidden equilateral triangle

This is the equilateral triangle of which none of the three sides is coincident with the line segment 14, 16 or 18 and horizontal or vertical. So far as there are given a pair of crosses corresponding to two apecies of an imaginary triangle, it is always possible to find a remaining cross that can define together with said pair of crosses an equilateral triangle. However, it is not always possible to find such remaining cross within the area of the game board 10.

Approximately 780 equilateral triangles of three types as mentioned above which are various in their sizes are latently contained within the effective area of the game board 10.

DEMONSTRATION OF HIDDEN EQUILATERAL TRIANGLE

Figure 4:
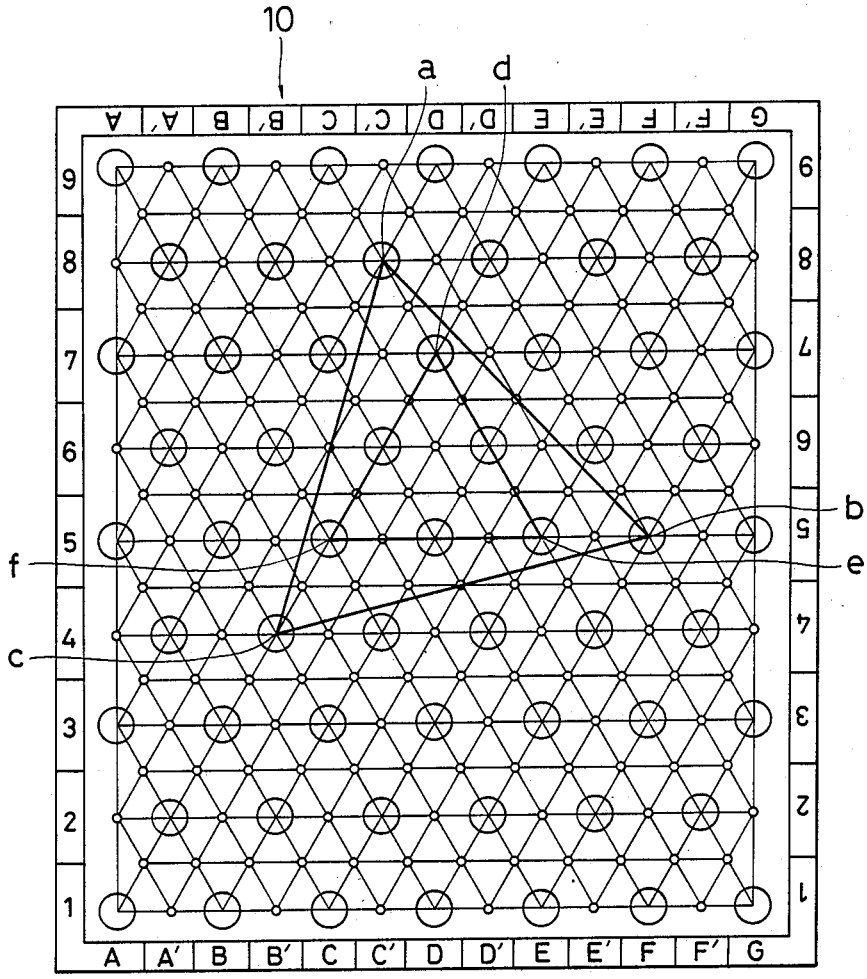

Now it will be demonstrated that Δabc shown in FIG. 4 is an equilateral triangle.

PRECONDITION

The crosses 12 on the game board 10 correspond to the crosses of the congruent equilateral triangular grids.

HYPOTHESIS

If Δdef is an equilateral triangle, Δabc should also be an equilateral triangle.

DEMONSTRATION $$\Delta fbc \text{ is congruent with } \Delta dca \qquad (1)$$

because $fc = da$ $fb = dc$ $\angle cbf = \Delta adc = 120°$

∴The angles included by respective pairs of adjacent sides are equal to one another and, therefore, Δfbc and 66 dca are congruent with each other.

Similarly, $\Delta eab$ is congruent with $\Delta fbc$ (2)

In view of the relationships (1) and (2), $$\Delta fcb \equiv \Delta dca \equiv \Delta eab \quad (3)$$

Based on the relationship (3), $ab = bc = ca$ $\therefore$ Three sides are equal in their length and therefore $\Delta abc$ is an equilateral triangle. Thus, the hypothesis has been demonstrated.

PLAY TIME

Usually no time limit is provided for playing of a game. However, a specific time limit is provided for a formal contest or the like. An example of such time limit will be described.

(1) one move within 30 seconds

Each player must, in his (her) turn, play (place or move his (her) piece on the board) within 30 seconds from a moment at which the opponent has completed his (her) play.

(2) consideration within 10 minutes

If the play time of 30 seconds has been exceeded, further 10 minutes can be assigned to each player as the consideration time. If the consideration time of 10 minutes has been accumulatively exceeded, the player must play within 30 second thereafter and would become the loser if this player has failed to play within said 30 seconds, according to a rule of overtime.

An embodiment of the game utilizing the game board 10 and the pieces 30, 40 of the invention is developed as has been described hereinabove.

Sometimes it is difficult for a beginner to judge a formation of the hidden equilateral triangle and it is also not easy to determine whetehr the piece(s) 30, 40 is(are) present on any sides or within an equilateral triangle. To assist the beginner for such difficulties, the present invention provides a scale 50 made of transparent vinyl sheet on which all the equilateral triangles to be formed on the game board 10 are described (see FIG. 5). Of the parallel line segments, those indicated by solid lines correspond to the hidden equilateral triangles, those indicated by broken lines correspond to the equilateral triangels including respective one sides extending in the vertical direction, and those indicated by single-dotted chain lines correspond to the equilateral triangles including respective one sides extending in the horizontal direction.

To determine whether an equilateral triangle is established or not by using this sacle 50, an apex 0 of the sacle 50 is centrally positioned on one of the pieces 30, 40 (cross 12) and one of oblique sides is positioned so as to pass through a centre of the other piece 30, 40 (cross 12). By positioning the scale 50 in this manner, it is easily determined whether three pieces define an equilateral triangle depending upon whether a centre of the third piece lies on the base of the corresponding equilateral on the scale 50, since such base passing through the centre of said other piece 30, 40 (cross 12) esxist as a matter of course.

It is also possible, by positioning the apex 0 of the scale 50 on the piece 30, 40 already placed on the game board and then rotating the scale 50 around said apex, to determine whether a new equilateral triangle is defined by said piece 30, 40 placed on the game board.

Figure 6:
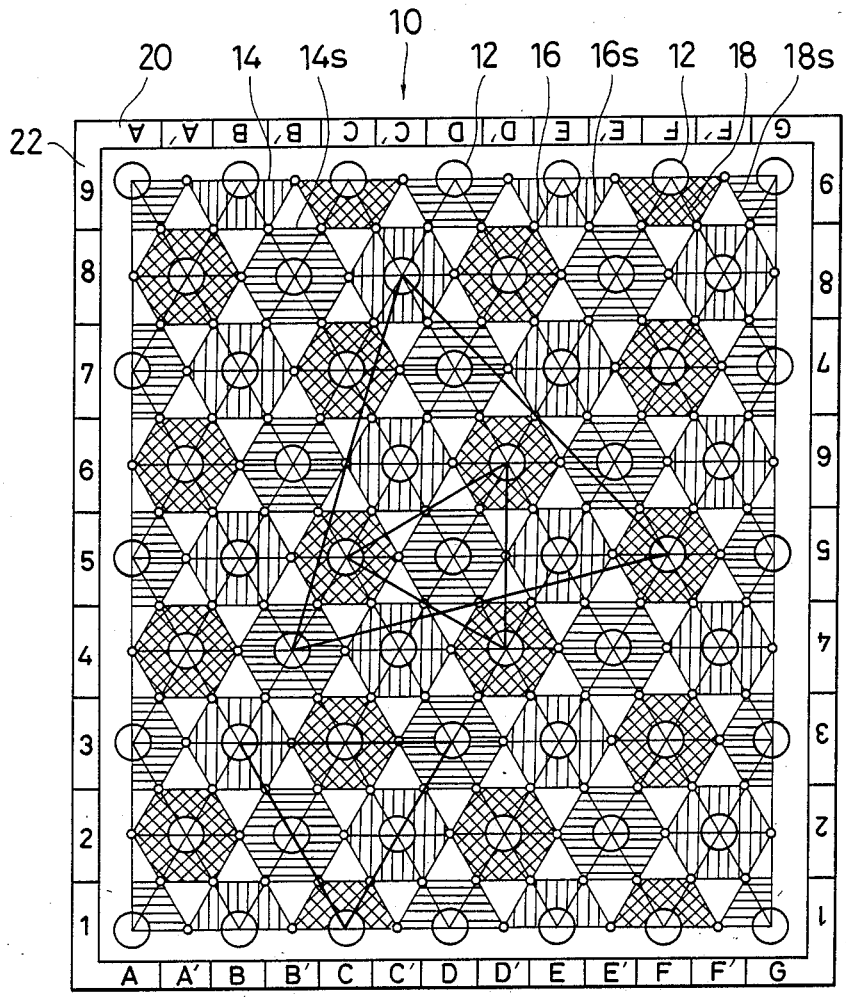
FIG 6 is a top view showing a variant of the game board.

FIG. 6 is a plan view showing another embodiment of the game board 10 which facilitates the determination of whether an equilateral triangle has been established or not. This game board is bascially identical to that as shown by FIG. 1, so the same parts are designated with the same reference numerals and repeated explanation will be avoided.

This game board differs from that of FIG. 1 in that the respective crosses 12 are distinguishied from one another by threecolors (e.g., red, blue an yellow) put on each minimum hexagonal area surrounding each cross 12. These three colors are put on the respective hexagonal areas in sequentially repeated mode along every line segment. It should be understood that the color defference is represented by a plurality of horizontally parallel line segments, vertically parallel line segments and crossing obliquie line segments within each hexagonal area, because the drawing can not be colored.

The present embodiment is advantageous in that, when an equilateral triangle is formed by three pieces placed on the respective crosses 12, all these three crosses 12 are "of a same color" or "of different colors". Accordingly, this particular characteristc can be utilized as a criterium to determine whether and equilateral triangle is established or not. FIG. 6 contains the erected or inverted equilateral triangle, the laterally pointing equilateral triangle and the hidden equilateral triangle as shown in FIGS. 3 and 4 at the positions same as in said FIGS. 3 and 4. It will be apparent from FIG. 6 that these equilateral triangles of three types meet the requirement as above-mentioned.

Although the embodiments of the present invention have been described hereinbefore in reference with the accompanying drawings, various modifications are possible with respect to the construction of the game board 10, for example, pitch, number, lenght/breadth ratio and other factors of the crosses 12 or configuration of the piecee 30, 40 without departure from the spirit and the scope of the invention. Particularly, it should be taken into consideration that, instead of using three groups of line segments as in the illustrated embodiments, desired crosses may be defined by the intersecting points of at least two groups of line segments each of which extend in parallel to one another and intersect at an angle of 60° the other group of line segments, wherein all the individual line segments of said both groups extend at uniform intervals, respectively.

Both the means to identify the face and the back of each piece and the means used on the game board shown by FIG. 6 to group the crosses into three types are not limited to the colors as in the illustrated embodiments and may include various types of marking such as patterns and symbols. Furthermore, the markings included in each type need not be uniform and may be those which can be recognized at least to be not covered by any other types.

The rules of game also may be modified. To adapt the game for the beginner or to shorten the game time, it is possible to reduce the number of pieces to be held by the respective players and to provide a rule such that the piece(s) once taken can not be reused.

EFFECT OF THE INVENTION

As will be readily apparent from the aforegoing description of the game kit of the present invention, the game is developed in consideration of many equilateral triangles latenly established within the effective area of the game board. In consequence, penetrative, intuitive and concentrative abilities are thereby cultivated. Accordingly, the present invention is significantly effective in preventing one from becoming dull and in intellectual training of children.

A fact that the hidden equilateral triangles having apieces not interconnected by the line segments successively appear on locations on the game board which are different from those which can be easily imagined for the ordinary equilateral triangles offers the players a simple but variable game, for example, as based on a time of the cosmic space.

Figure 5:
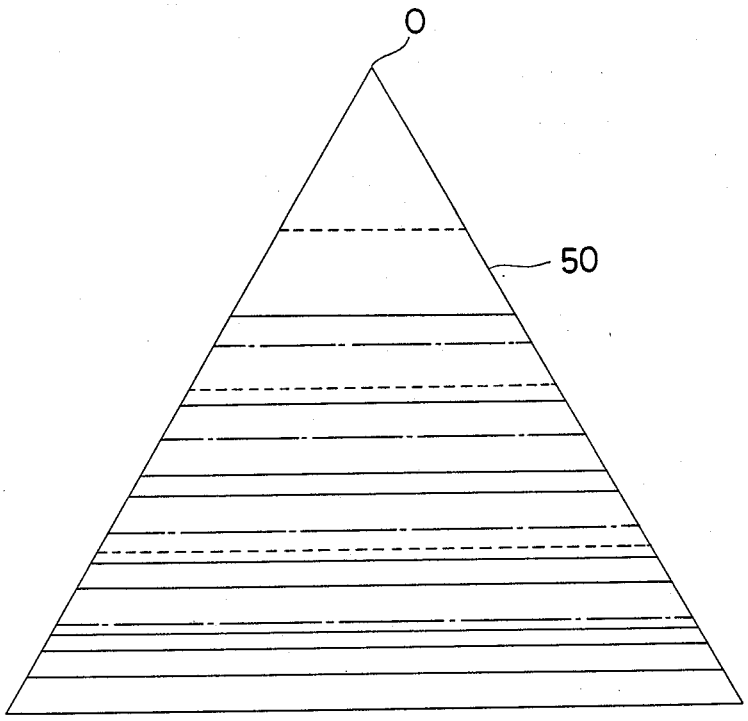
FIG. 5 is a plan view showing a scale used for the game using the same embodiment.

With the specific embodiment in which the crosses are grouped as illustrated in FIG. 6, it is easily possible to determine whether an equilateral triangle is established or not without use of the scale 50 as shown by FIG. 5, so that the game can be played even by children.

What is claimed is:

1. Game kit comprising a game board with crosses thereon corresponding to respective intersecting points of line segments and a plurality of pieces to be set up on said crosses; said crosses corresponding to the intersecting points of three gruops of line segments, each group of line segments extending in parallel to one another and intersecting at an angle of 60° with the other two groups of line segments, and all the line segments of said groups extending at uniform intervals; said crosses corresponding to apices of equilateral triangular grids formed by said three groups of line segments; auxiliary line segments lying midway between and parallel to respective pairs of adjacent line segments forming additional intersecting points of auxiliary line segments; said crosses of the line segments and the additional intersecting points of said auxiliary line segments being visually distinguishable from one another; and each of said pieces being adapted to be used on the game board selectively with its face or back directed upwards and provided with markings to identify said face and back.

2. Game kit as recited in claim 1, characterized in that said pieces are discoidal and provided centrally on the faces and backs with smaller circles of different colors, respectively.

3. Game kit comprising a game board formed thereon with crosses corresponding to respective intersecting points of line segments and a plurality of pieces to be set up on said crosses, characterized in that said crosses correspond to intersecting points of at least two groups of line segments, each group of line segments extending in parallel to one another and intersecting at an angle of 60° relative to the other group of line segments and all the line segments of said both groups extending at uniform intervals, respectively; that said crosses are provided with markings of three different types in such a manner that these markings of three different types are sequentially repeated along all the line segments and thereby said crosses are identified; and that each of said pieces is adapted to be used on the game board selectively with its face or back directed upwards and provided with markings to identify said face and back.

4. Game kit as recited in claim 3, characterized in that said crosses correspond to apieces of equilateral triangular grids formed by three groups of line segments, each group of line segments extending in parallel to one another and intersecting at an angle of 60° relative to the remaining groups of line segments and all the line segments of said three groups extending at uniform intervals, respectively; and that there are provided auxiliary line segments lying midway between the respective pairs of adjacent line segments in parallel to the associated adjacent line segments.

5. Game kit as recited in claim 3, characterized in that said pieces are discoidal and provided centrally on the faces and backs with smaller circles of different colors, respectively.

* * * * *